United States Patent [19]

Adler

[11] Patent Number: 4,560,358

[45] Date of Patent: Dec. 24, 1985

[54] GLIDING RING

[76] Inventor: Alan J. Adler, 752 La Para Ave., Palo Alto, Calif. 94306

[21] Appl. No.: 608,791

[22] Filed: May 10, 1984

[51] Int. Cl.[4] ..... A63H 27/00

[52] U.S. Cl. ..... 446/46; 273/425; 244/34 A

[58] Field of Search ..... 446/46, 47, 48; 273/424, 425, 109; 244/34 A, 45 R

[56] References Cited

U.S. PATENT DOCUMENTS

| | | | |
|---|---|---|---|
| 248.901 | 11/1881 | Wetherill | 273/425 |
| D. 253,004 | 9/1979 | Meckstroth | D21/86 |
| 678,265 | 7/1901 | Low | 273/425 |
| 708,519 | 9/1902 | Bradshaw | 273/425 |
| 1,986,937 | 1/1935 | MacGregor | 273/106 |
| 3,566,532 | 3/1971 | Wilson | 273/424 |
| 3,580,580 | 5/1971 | Wark et al. | 273/106 |
| 3,590,518 | 7/1971 | LeBaron | 46/81 |
| 3,594,945 | 7/1971 | Turney | 46/74 R |
| 3,724,122 | 4/1973 | Gillespie, Sr. | 446/46 |
| 3,765,122 | 10/1973 | English | 46/74 D |
| 4,104,822 | 8/1978 | Rodgers | 46/74 D |
| 4,174,834 | 11/1979 | DeMartino | 273/96 B |
| 4,279,097 | 7/1981 | Walker | 273/424 |
| 4,307,535 | 12/1981 | Martin | 446/48 |
| 4,456,265 | 6/1984 | Adler | 273/425 |

FOREIGN PATENT DOCUMENTS 2031745A 4/1980 United Kingdom .

*Primary Examiner*—Robert A. Hafer
*Assistant Examiner*—Daniel Nolan
*Attorney, Agent, or Firm*—Limbach, Limbach & Sutton

[57] ABSTRACT

A gliding ring toy comprised of a closed-figure airfoil with a narrow separator lip on the outer perimeter of the upper surface in order to balance the aerodynamic lift, fore and aft, over a wide range of velocities in gliding flight.

15 Claims, 11 Drawing Figures

GLIDING RING

BACKGROUND OF THE INVENTION

1. Field of the Invention

This invention relates to amusement devices or toys and more specifically to aerial flying ring devices.

2. Prior Art

There have been numerous prior aerial gliding rings. A gliding ring is defined as a light weight closed-figure airfoil, having a weight of less than 10 grams per square centimeter of airfoil surface, which when thrown with a spinning motion and a speed of less than 30 meters per second, will glide, supported by aerodynamic lift produced by the flow of air over its surface. Some of these prior devices are listed below U.S. Pat. No. 248,901—Wetherill
U.S. Pat. No. 708,519—Bradshaw
U.S. Pat. No. 3,580,580—Wark & Schladermundt
U.S. Pat. No. 3,590,518—LeBaron
U.S. Pat. No. 3,594,945—Turney
U.S. Pat. No. 3,765,122—English
U.S. Pat. No. 4,104,822—Rodgers
U.S. Pat. No. 4,174,834—De Martino
U.S. Pat. No. Des. 253,004—Meckstroth
U.S. Patent application filed 1/16/79 Ser. No. 3,992—Adler (now Pat. No. 4,456,265)
U.K. Pat. No. 2031745—English Bradshaw, Wark & Schladermundt, English, Meckstroth, and English (U.K.) all disclose rings which are formed with one or more downwardly depending flanges. De Martino discloses a stick-propelled ring which is comprised of a thin flat ring-portion with adjoining, thicker, rounded inner and outer edges. Wetherill, Turney, LeBaron, Rodgers and Adler disclose rings without flanges. The LeBaron ring is preferably rubber-band launched without spin.

Bradshaw, Wark & Schladermundt, and English discuss the necessity of the downwardly depending flanges to achieve stable flight. Turney and Rodgers achieve stable flight by means of airfoils substantially thicker than those disclosed by the other inventors. De Martino states that his edges are rounded for safety and to achieve laminar airflow.

With the exception of the Adler design, the above rings have relatively short flight distances.

Adler (who is also the present inventor) achieved stable flight by means of an angled airfoil. The Adler invention was marketed under the trademark Skyro and is cited in the Guinness Book of World Records for the longest throw of an inert heavier than air object (857 feet 8 inches).

The Adler invention achieved long distance by having much lower aerodynamic drag than previous gliding rings. The Adler design employs an angled airfoil to produce stable flight. The Adler specification discloses an equation (3) for the airfoil angle which shows that the optimum angle is proportional to the inverse of the "intended flight velocity" squared. When this device flies at velocities below or above the "intended flight velocity" it will bank either to the left or the right.

SUMMARY OF THE INVENTION

The present invention consists of a thin, lightweight, gliding ring which can be thrown with a spinning action and caught in a manner similar to other gliding rings but is capable of long flights combined with stability over a wide range of flight velocities. A unique feature of the present invention is a narrow separator lip on the outer perimeter of the upper surface. The present inventor has discovered that this lip causes the ring to have stable flight over a wide range of flight velocities combined with the capability of long distance flights.

The invention and the features and advantages thereof will be described in greater detail below with reference to the accompanying drawings wherin similar characters of reference refer to similar structure in each of the several views.

DETAILED DESCRIPTION OF THE INVENTION

Figure 1:
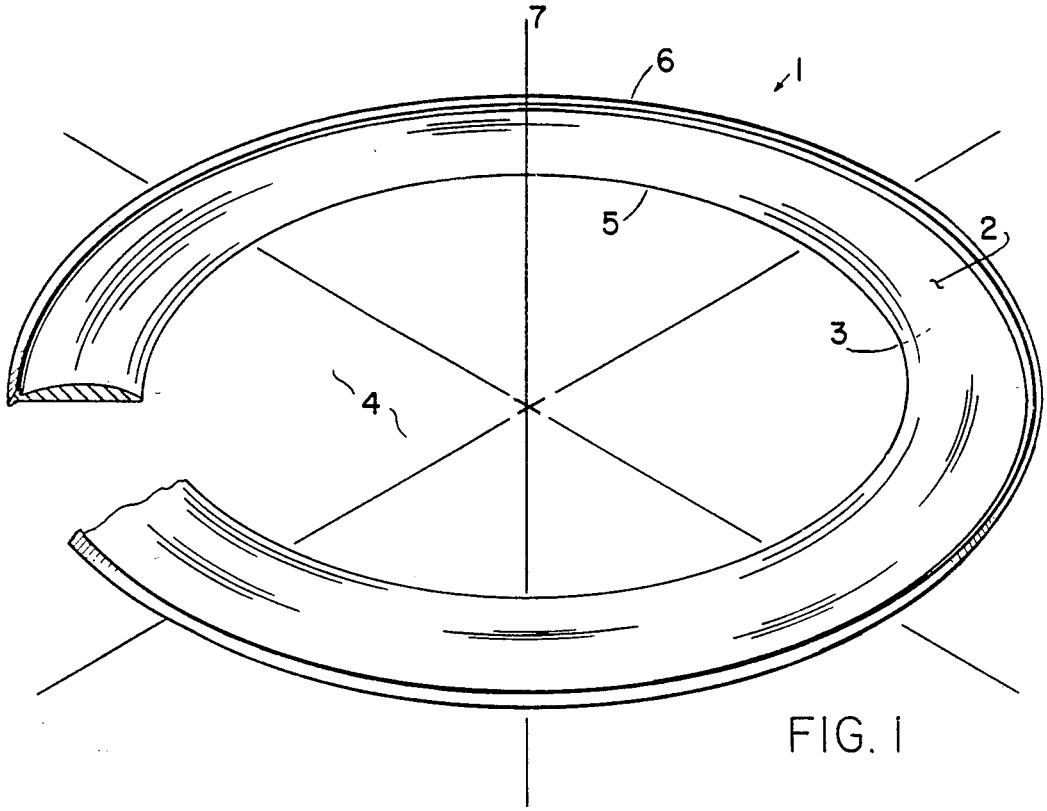
FIG. 1. is a cutaway isometric view of the preferred embodiment of the present invention.

FIG. 1 is a cutaway isometric view of the gliding body of the preferred embodiment of the invention. It consists of a thin closed-figure airfoil 1, having an upper surface 2, a lower surface 3, a central opening 4, an inner perimeter 5, an outer perimeter 6, and an axis of revolution 7 which is substantially normal to the planes described by said inner and outer perimeters. Other details of the invention will be discussed while referencing the remaining figures.

FIGS. 2A–2E show the planforms of a variety of closed-figure airfoils in accordance with this invention. A closed figure airfoil is defined as an airfoil having a planform which forms a closed figure. Such a planform has a central opening 4, an inner perimeter 5 encompassing said central opening, an outer perimeter 6 encompassing said inner perimeter, and an axis of revolution which is substantially normal to the the planes described by said inner and outer perimeters.

Figure 2A:
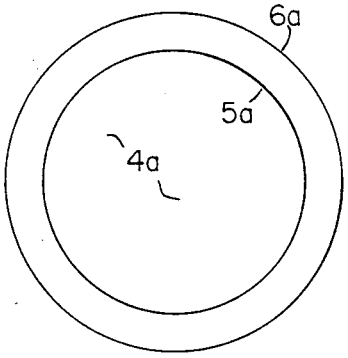
FIGS. 2A–2E show several alternative planforms for the closed-figure airfoil of the invention. An annulus is shown in 2A; a multi-lobed form is shown in 2B; an elliptical form is shown in 2C; an eccentric annulus is shown in 2D; and a polygon is shown in 2E.
Figure 2B:
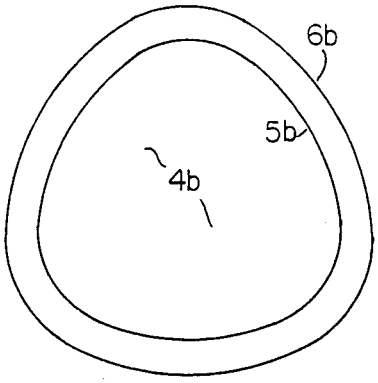
Figure 2C:
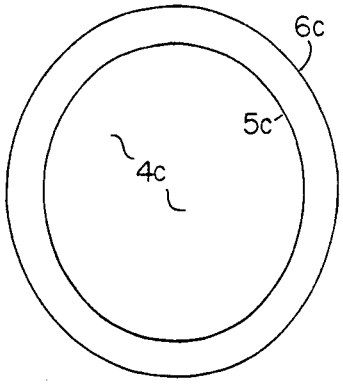
Figure 2D:
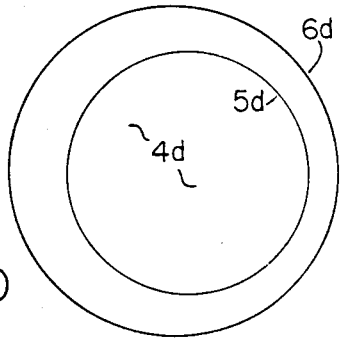
Figure 2E:
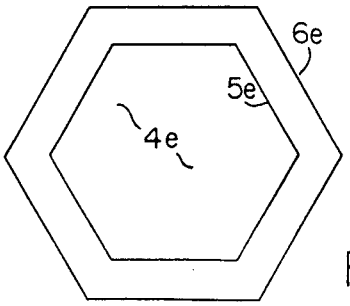

Note that a closed-figure airfoil can be formed by two concentric circles forming an anular ring (FIG. 3A), by two concentric multi-lobed figures (FIG. 2B), by two concentric ellipses (FIG. 2C), by two eccentric circles (FIG. 2D), or by two concentric polygons (FIG. 2E).

A closed-figure airfoil can also be described by numerous other combinations of closed figures, for example a circular outer perimeter and a triangular inner perimeter as disclosed by Meckstroth.

Figure 3A:
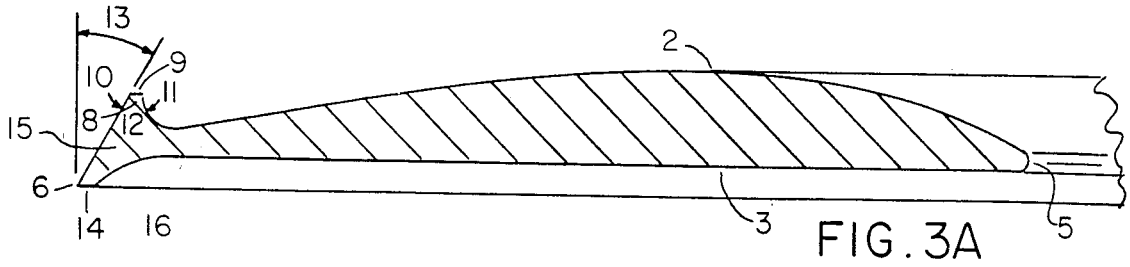
FIGS. 3A–3D show several alternative cross-sections of the invention. These alternative cross-sections will be discussed in the disclosure that follows.

FIG. 3A shows the airfoil cross-section of the preferred embodiment of the present invention. The cross-section embodies a line 3 defining the lower surface and a convex line 2 defining the upper surface. A unique feature of the present invention is the separator lip 8, on the outer perimeter of the uper surface. Note that this lip extends upward to a narrow peak 9 which is higher than the immediately adjacent portion of the upper surface of the airfoil. It was discovered that this lip, when shaped as disclosed herein, allows the ring to achieve stable flight over a wide range of velocities.

The lip 8 is referenced as a separator lip because it is believed that the lip causes the airflow to separate from the leading edge of the forward portion of the airfoil. It is further believed that this separator lip reduces the lift slope of the forward portion of the airfoil so that it becomes balanced with the lift slope of the aft portion of the ring. The lift slope is the rate of change of lift versus angle of incidence or dL/dA, where L=lift and A=angle of incidence.

It is believed that the lift slopes of the forward and aft sections of the ring have become matched (due to the action of the separator lip) because the ring is stable over a wide range of flight velocity and angle of incidence.

The inventor has discovered that an important parameter of the separator lip 8 is that it must have a narrow peak 9 in order to produce the stable flight described above. In the preferred embodiment the width of the peak is less than 1 mm. In the preferred embodiment this peak is substantially defined by the joining together of the surfaces 10 and 11 immediately adjacent to said peak. It has been found that for stable flight, the angle 12 between said adjacent surfaces should be less than 60 degrees.

Another important parameter of the separator lip 8 discovered by the present inventor is the angle 13 formed between a line tangent to the lip's outer surface 10 and the axis of revolution the body. If this angle is too great, straight flight will not be maintained over a wide range of velocities.

The present inventor has found that as the angle 13 is increased there is a reduction in stability. For example, a ring with an angle of 45 degrees was found to have less stability than other rings with smaller angles. In the preferred embodiment of the invention, this angle is approximately 30 degrees.

Figure 3B:
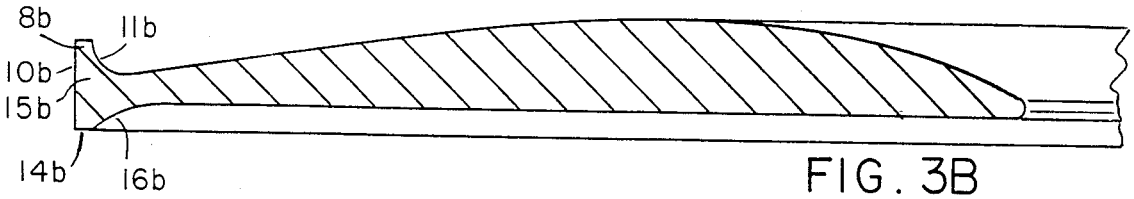
Figure 3C:
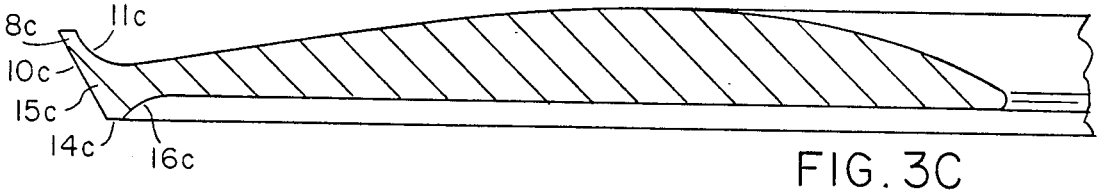

Other angles 13 are illustrated in FIGS. 3B and 3C. FIG. 3B shows an angle of zero degrees and FIG. 3C shows an angle of minus 30 degrees. These sections are stable but have shorter flight range than the preferred embodiment of FIG. 3A.

While the sections shown in FIG. 3 illustrate a straight line defining the outer edge of the lip, which creates a conical surface, it is believed that stable flight could be also achieved if this line was curved, provided that the peak of the lip was narrow.

Another important parameter of the present invention is that the line defining the upper surface 2 of the airfoil section is convex in order to develop adequate lift combined with stability and low drag. In the preferred embodiment of the invention the zenith of said convex upper surface 2 is the highest point on the airfoil section. It was found that best results were achieved when this zenith is closer to the inner perimeter than to the outer. The preferred location for this zenith was found to be about one third of the distance from the inner to the outer perimeter.

Continuing with FIG. 3A, note that the airfoil section has a substantially straight line 3 describing a substantially flat lower surface except for a downwardly depending flap 14 in the region of the outer perimeter of the lower surface. It was discovered that this flap caused the invention to have balanced flight. This flap is also illustrated in the alternative sections shown in 3B and 3C.

Figure 3D:
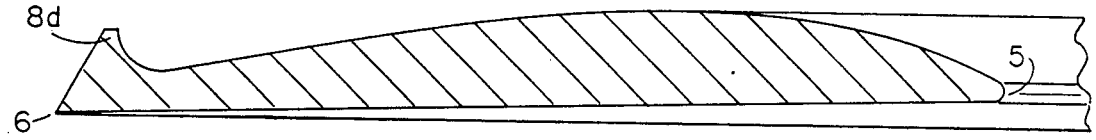

FIG. 3D illustrates an alternative to the flap 14. That is an angled airfoil in which the inner perimeter 5 is higher than the outer perimeter 6. It has been found that either this higher inner perimeter, or the flap 14, or a combination of these features is needed to achieve stable flight.

An alternative method of describing the separator lip 8 and the flap 14 would be to say that the gliding body includes an outer rim 15 adjacent to its outer perimeter. This rim 15 is comprised of; an outer rim surface 10 extending from a bottom edge 14 below the lower airfoil surface 3 to a top edge 9 above the outer portion of the upper airfoil surface 2, an upper-inner rim surface 11 extending downward from said top edge 9 to the outer portion of said upper airfoil surface 2, a lower-inner rim surface 16 extending upward from said bottom edge 14 to said lower airfoil surface 3.

Figure 4:
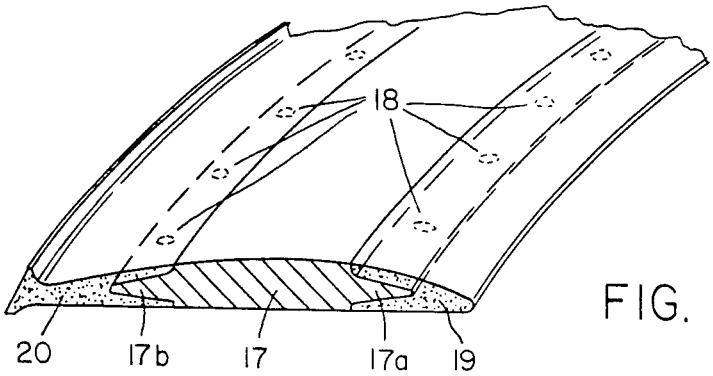
FIG. 4. illustrates the preferred manufacturing method of the invention.

FIG. 4 illustrates the preferred method of manufacturing the invention. The invention is comprised of a central plastic armature ring 17 which is separately molded from high-impact thermoplastic. Note that the armature has thin tongues **17*a* and 17*b* on its inner and outer edges. These tongues have a plurality of throughholes 18. The armature is placed in a second mold and thermoplastic elastomer is injected to form the inner and outer cushions 19 and 20. During injection the elastomer flows through the holes 18** and becomes linked to the armature. The finished product is safer and more comfortable to catch as a result of the soft cushions.

It has been found that the ring flies greater distances if the upper and lower surfaces are slightly textured. The preferred amount of texture was found to be approximately the equivalent of #400 to #600 grit abrasive paper. The texture also improves the grip for throwing and catching.

While the foregoing is believed sufficient disclosure to enable a person skilled in the art to produce an article of the type covered by the appended claims, the detailed dimensions of an example embodiment of the invention are given below:

Diameter of outer perimeter=330 mm
Diameter of inner perimeter=254 mm
Airfoil chord=38 mm
Maximum airfoil thickness=3.8 mm (measured from the zenith of the convex upper surface to the lower surface immediately below)
Flap deflection from lower tip of flap to lower surface of airfoil=1 mm
Height of separator lip peak above immediately adjacent airfoil surface=1.2 mm
Height of separator lip peak above lower tip of flap=3.6 mm
Weight=107 grams or 3.26 grams per square centimeter of airfoil surface The ring has been thrown more than two hundred meters and has demonstrated exceptional stability over a range of flight velocities from a few meters per second to twenty meters per second. A typical average flight velocity would be approximately ten meters per second.

While in the foregoing specification embodiments of the invention have been set forth in considerable detail for purposes of making a complete disclosure therof, it will be apparent to those skilled in the art that certain changes may be made in certain details without departing from the spirit and principles of the invention.

I claim:

1. A gliding ring comprising;

a closed-figure airfoil having a planform comprising;

an upper and lower surface, a central opening, an inner perimeter encompassing said central opening, an outer perimeter encompassing said inner perimeter, an axis of revolution which is substantially normal to the planes described by said inner and outer perimeters, said airfoil having a cross-section comprising;

a line defining said lower surface, a convex line defining said upper surface, said convex line reaching a zenith which is the highest point on the airfoil section of said ring, a separator lip on said upper surface and located on or near said outer perimeter, said separator lip extending to a narrow peak which is higher than the immediately adjacent portion of said upper surface.

2. A gliding ring as recited in claim 1 wherein said inner perimeter is higher than said outer perimeter.

3. A gliding ring as recited in claim 1 wherein said airfoil section has a downwardly depending flap adjacent to said outer perimeter.

4. A gliding ring as recited in claim 1 wherein a line tangent to said outer surface of said separator lip is within plus or minus 45 degrees of parallelism to said axis of revolution.

5. A gliding ring as recited in claim 1 wherein said inner and outer perimeters are circles described about said axis of revolution.

6. A gliding ring as recited in claim 1 wherein said body has a weight of less than 10 grams per square centimeter of airfoil surface, so as to be capable of gliding while supported by aerodynamic lift at speeds of less than 30 meters per second.

7. A gliding ring as recited in claim 1 wherein said upper and lower surfaces are textured to improve aerodynamic performance and grip.

8. A gliding ring as recited in claim 1 wherein said convex line, defining said upper surface, reaches said zenith at a location which is substantially one third of the distance from the inner perimeter to the outer perimeter.

9. A gliding ring as recited in claim 1 having a high-impact thermoplastic armature ring joined to an elastomeric outer cushion.

10. A gliding ring comprising;

an annular airfoil having a planform comprising;

an upper and lower surface, a central opening, a circular inner perimeter encompassing said central opening, a circular outer perimeter encompassing said inner perimeter, an axis of revolution passing though the centers of said circular inner and outer perimeters which is substantially normal to the planes described by said inner and outer perimeters, said airfoil having a cross-section comprising;

a lower surface which is substantially flat, except in the region of the outer perimeter as recited below, a convex line defining said upper surface, said convex line reaching a zenith at a location which is substantially one third of the distance from said inner perimeter to said outer perimeter, said zenith region being the highest portion of said ring, and a separator lip on said upper surface and located on or near said outer perimeter, said separator lip extending to a narrow peak which is higher than the immediately adjacent portion of said upper surface but lower than said zenith of said convex upper surface, a downwardly depending flap adjacent to said outer perimeter of said lower surface.

11. A gliding ring as recited in claim 10 wherein;

the diameter of said inner perimeter is 254 mm, the diameter of said outer perimeter is 330 mm, the vertical distance from said zenith of said convex upper surface to said lower surface is 3.8 mm, said separator lip reaches a peak which is 0.75 mm wide and 1.2 mm higher than the immediately adjacent upper surface of said airfoil section, said downwardly depending flap extends 1 mm below said flat lower airfoil surface.

12. A gliding ring comprising;

a lower airfoil surface, an upper airfoil surface, a central opening;

an inner perimeter encompassing said central opening, an outer perimeter encompassing said inner perimeter, an outer rim adjacent to said outer perimeter comprising;

an outer rim surface extending from a bottom edge below said lower airfoil surface to a top edge above the outer portion of said upper airfoil surface, an upper-inner rim surface extending downward from said top edge of said rim to the outer portion of said upper airfoil surface, a lower-inner rim surface extending upward from said bottom edge of said rim to said lower airfoil surface, said upper airfoil surface having a cross-section described by a convex line extending from said upper-inner rim surface to said inner perimeter, said convex line reaching a zenith which is the highest point on the airfoil section of said ring, an axis of revolution substantially normal to the planes described by said inner an outer perimeters.

13. A gliding ring as recited in claim 12 wherein said outer rim surface is sloped such that the circumference of said top edge said rim is smaller than the circumference of said bottom edge of said rim.

14. A gliding ring as recited in claim 12 wherein said inner perimeter, said outer perimeter, and said outer rim are all circular and co-axial—thus forming an annular airfoil.

15. A gliding ring as recited in claim 14 wherein said outer surface of said outer rim is substantially conical such that the diameter of said top edge of said rim is smaller than the diameter of said bottom edge of said rim.

* * * * *